US006951370B1

(12) United States Patent
Hsu

(10) Patent No.: US 6,951,370 B1
(45) Date of Patent: Oct. 4, 2005

(54) EXOTIC CHAIR

(76) Inventor: Hsiu-Hsia Hsu, No. 87, Baobu Rd., Changhua City, ChangHua County (TW)

( * ) Notice: Subject to any disclaimer, the term of this patent is extended or adjusted under 35 U.S.C. 154(b) by 0 days.

(21) Appl. No.: 10/739,568

(22) Filed: Dec. 19, 2003

(51) Int. Cl.[7] ..... A47C 3/20; A47C 1/02

(52) U.S. Cl. ..... 297/330; 297/260.2; 297/301.2; 297/339; 297/362.13

(58) Field of Search ..... 297/260.2, 301.2, 297/330, 338, 362.13, 339

(56) References Cited

U.S. PATENT DOCUMENTS 1,582,280 A * 4/1926 Koken ..... 297/344.2
2,053,852 A * 9/1936 Tracy ..... 188/109
3,019,052 A * 1/1962 Zawadzki ..... 297/260.2
3,824,991 A * 7/1974 Whitaker ..... 601/5
4,408,800 A * 10/1983 Knapp ..... 297/301.2
4,748,994 A * 6/1988 Schultz et al. ..... 135/67
4,860,733 A * 8/1989 Parker, Jr. ..... 601/24
6,688,694 B1 * 2/2004 Yu ..... 297/362.13
6,774,589 B2 * 8/2004 Sato et al. ..... 318/127

* cited by examiner

*Primary Examiner*—Peter M. Cuomo
*Assistant Examiner*—Joe Edell
(74) *Attorney, Agent, or Firm*—Egbert Law Offices

(57) ABSTRACT

A chair includes a seat frame, a seat movably mounted on the seat frame, a backrest pivoted to the seat frame, a reciprocating mechanism mounted under the seat frame to cause the seat to engage in a series of repeated up-and-down motions, and a reclining mechanism mounted under the seat frame to enable the backrest to be adjusted for reclining. The reciprocating mechanism has a transmission member which is driven by a motor and is provided with a contact portion in contact with the underside of the seat. The reclining mechanism includes a control lever for regulating the position of an actuation pin in a triangular hole of a position control plate such that the actuation pin serves to activate or deactivate a pressure release knob of a cylinder which is fastened at one end with the backrest.

7 Claims, 8 Drawing Sheets

EXOTIC CHAIR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a chair comprising a seat frame and a reciprocating mechanism enabling the seat frame to engage in a series of continuous, up-and-down motions, thereby providing a user of the chair with a touch of exoticism.

BACKGROUND OF THE INVENTION

In light of the fast-paced and success-oriented nature of the modern society, people from all walks of life are prone to stress. In order to help the modern people relieve such a mental or physical tension, an exotic chair is very helpful. The exotic chair of the present invention is intended to provide a user with a touch of fascination and enticement.

BRIEF SUMMARY OF THE INVENTION

The primary objective of the present invention is to provide an exotic chair for amusement. The exotic chair of the present invention comprises a seat and a backrest. The seat is provided with a reciprocating mechanism and a reclining mechanism. The reciprocating mechanism enables the seat to engage in a series of repeated rhythmic motions, whereas the reclining mechanism serves to adjust the backrest for reclining.

The features and the advantages of the present invention will be readily understood upon a thoughtful deliberation of the following detailed description of the present invention with reference to the accompanying drawings.

DETAILED DESCRIPTION OF THE INVENTION

Figure 1:
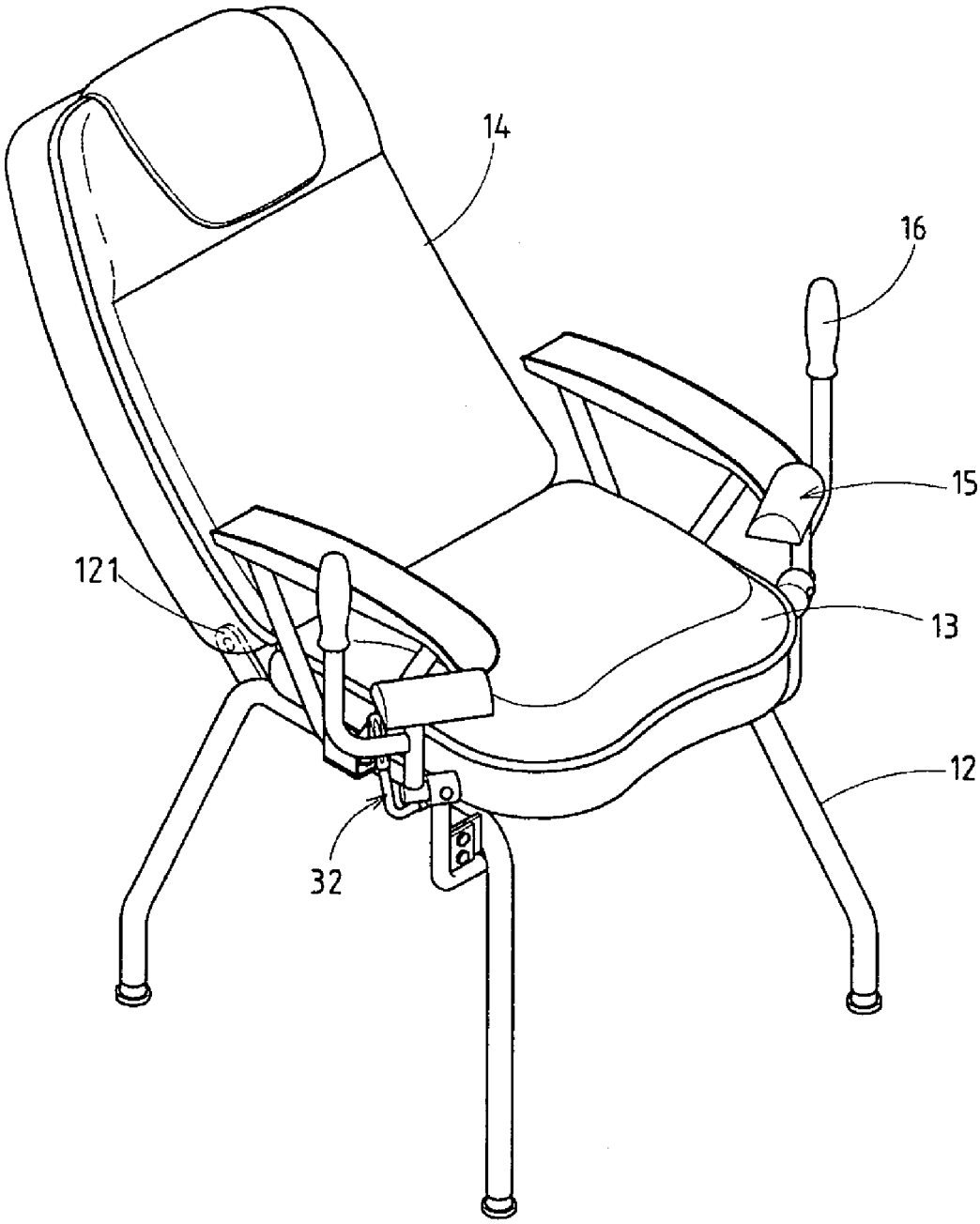
FIG. 1 shows a perspective view of the present invention.

As shown in all drawings provided herewith, an exotic chair embodied in the present invention comprises a seat frame 10, two armrests 11, four legs 12, a seat 13, a backrest 14, a reciprocating mechanism, and a reclining mechanism.

The reciprocating mechanism is mounted under the seat frame 10 and is formed of a fastening member 21, a drive motor 22, and a transmission member 24. The fastening member 21 is fastened at one end with the seat frame 10 and is used to mount the drive motor 22 such that an output shaft 23 of the drive motor 22 is pivotally fastened with a bottom end of the transmission member 24 by a pivot 25. It must be noted here that the output shaft 23 and the transmission member 24 are eccentrically fastened. The transmission member 24 is uprightly mounted in such a way that the upper segment of the transmission member 24 is embraced by a guide seat 26, and that a contact portion 27 of the top end of the transmission member 24 comes in contact with the underside of the seat 13. As the drive motor 22 is started, the transmission member 24 is driven to make a series of repeated up-and-down motions. As a result, the seat 13 is pushed by the contact portion 27 of the top end of the transmission member 24 to move up and down in a reciprocating manner.

Figure 2:
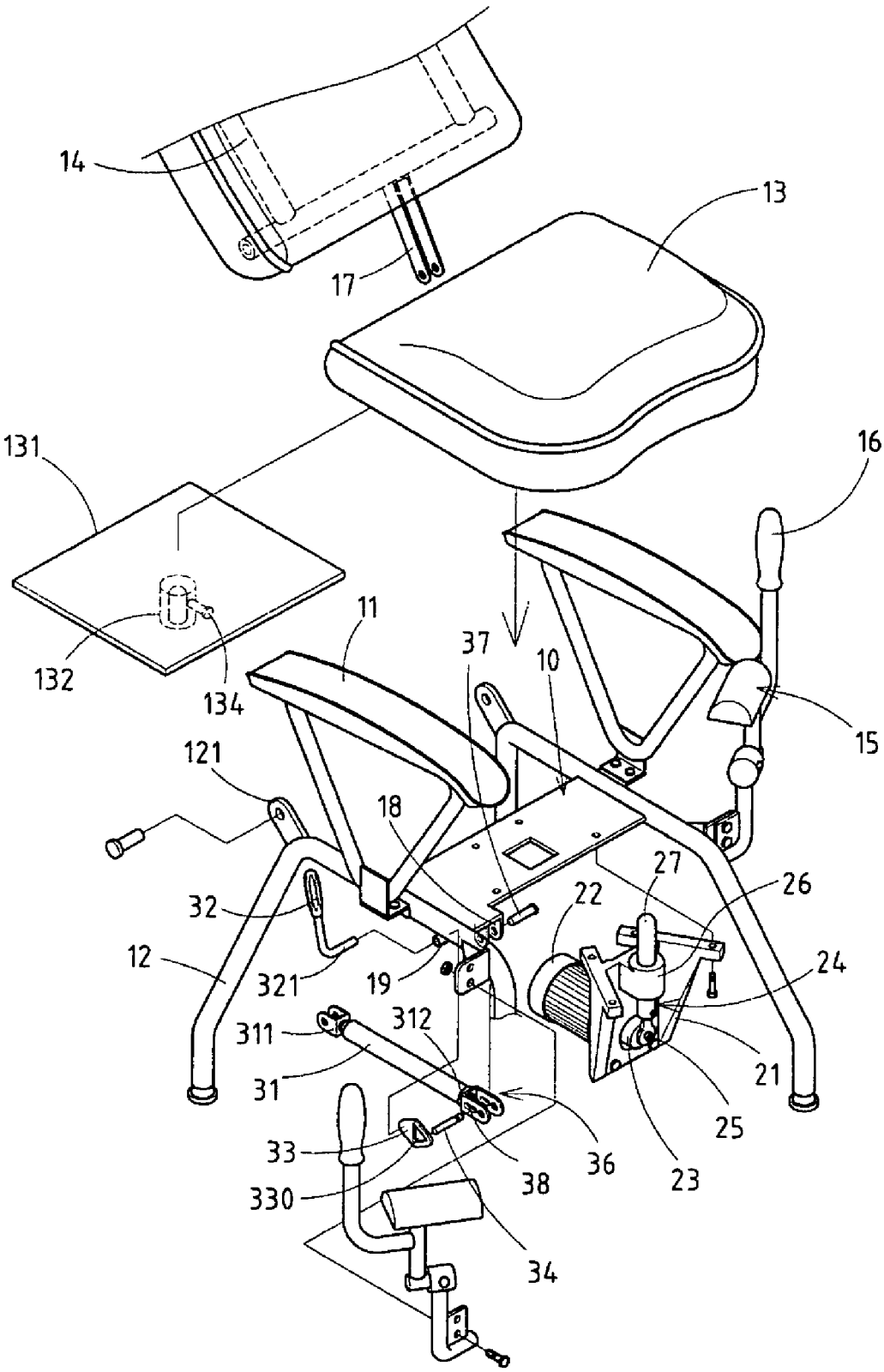
FIG. 2 shows an exploded perspective view of the present invention.
Figure 3:
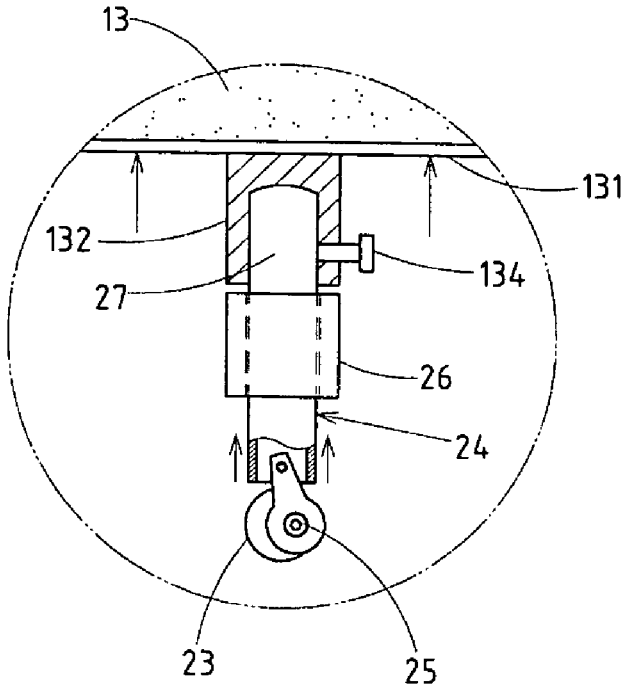
FIG. 3 shows a schematic view of the reciprocating mechanism of the present invention at work.
Figure 4:
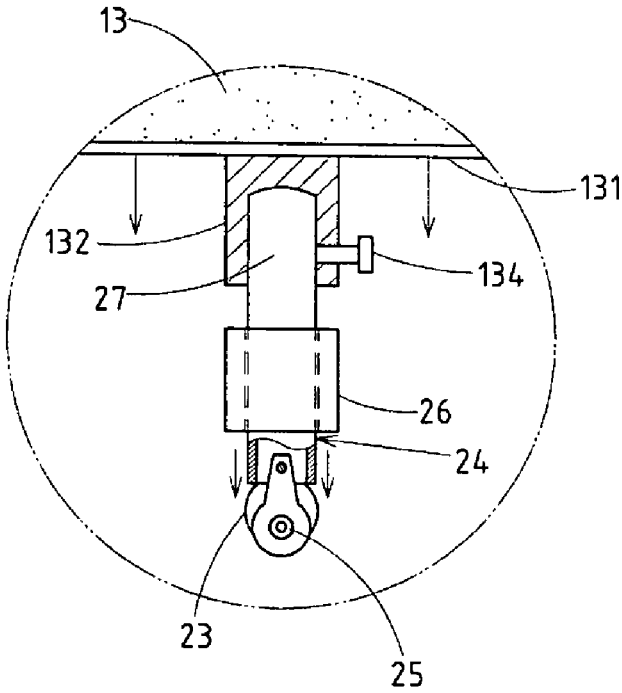
FIG. 4 shows another schematic view of the reciprocating mechanism of the present invention at work.
Figure 5:
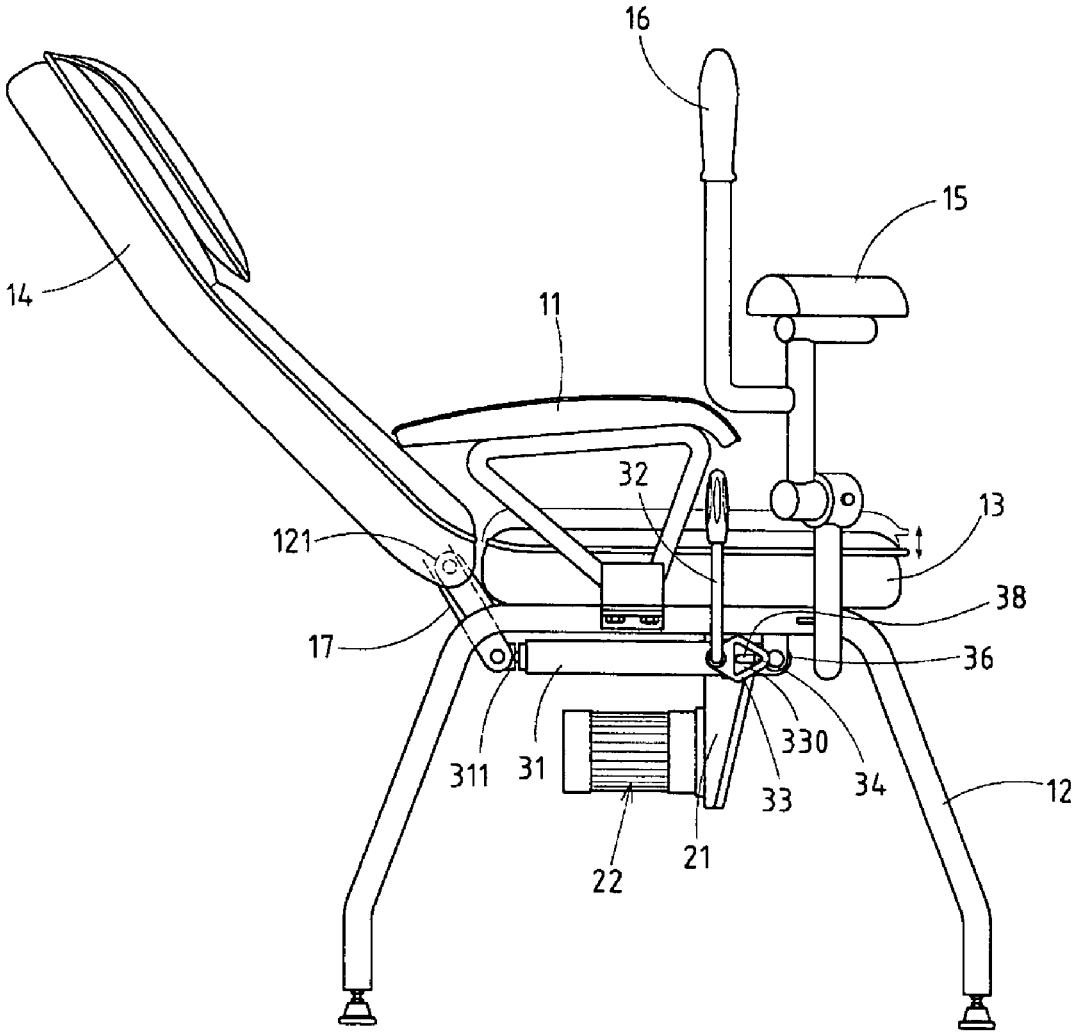
FIG. 5 shows a side schematic view of the present invention in its entirety.

As shown in FIGS. 2, 3, and 4, the seat 13 is provided in the underside with a rigid plate 131 which is in turn provided in the underside with a receptacle 132 fastened therewith. The contact portion 27 of the top end of the transmission member 24 is received in the receptacle 132. The contact portion 27 is located in the receptacle 132 by a locating bolt 134 whose shank presses against the contact portion 27.

Figure 6:
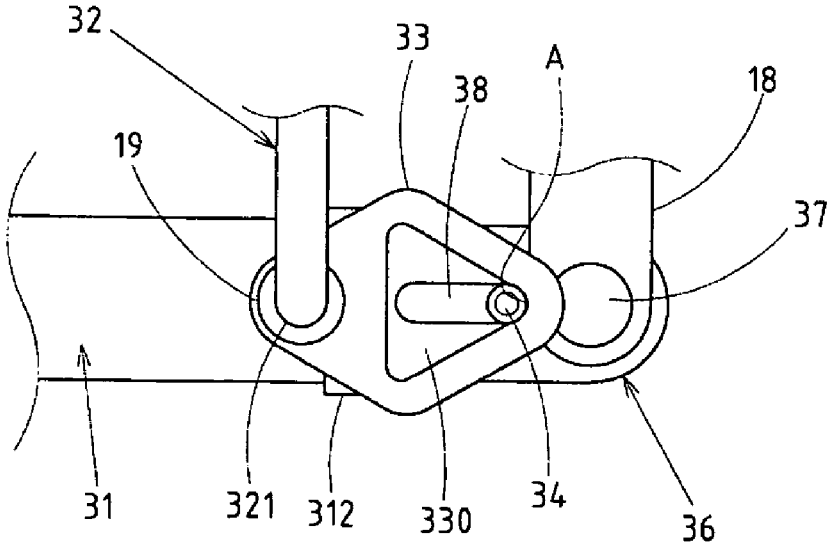
FIG. 6 shows a side schematic view of the reclining mechanism of the present invention.
Figure 7:
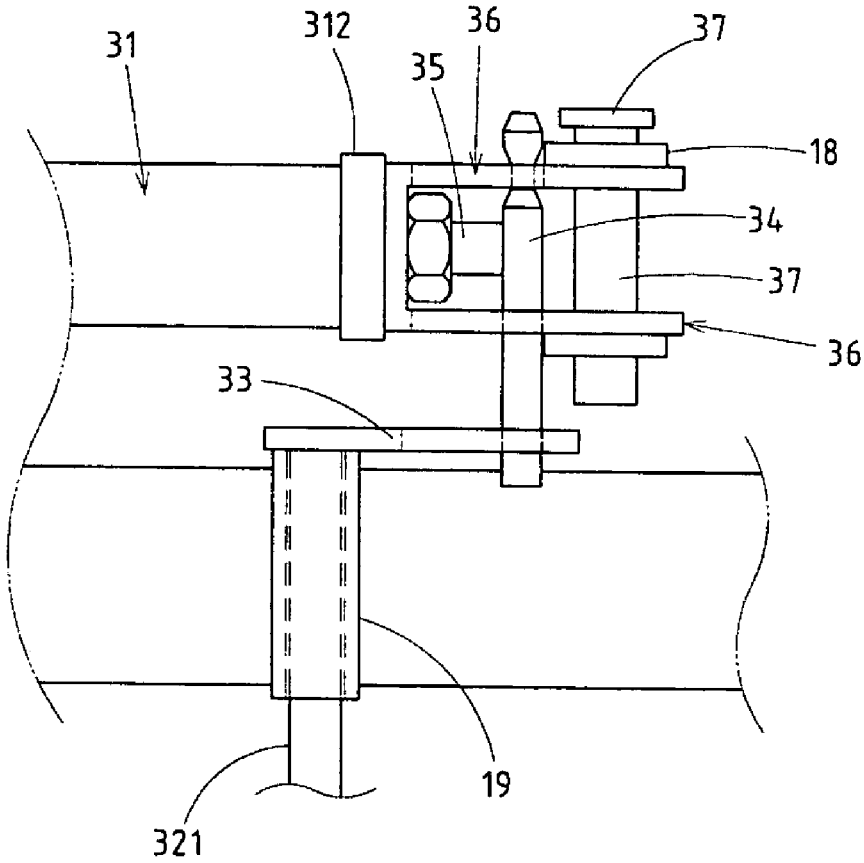
FIG. 7 shows a top plan view of the reclining mechanism of the present invention.
Figure 8:
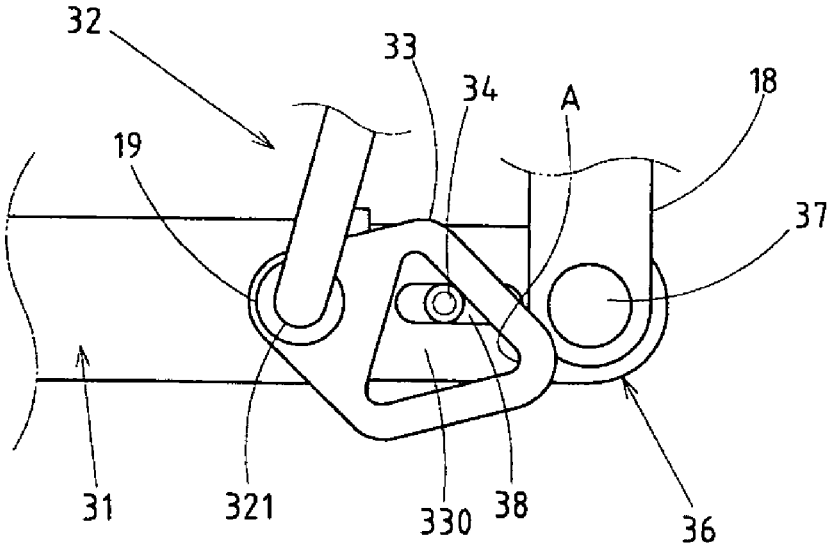
FIG. 8 shows a side schematic view of the reclining mechanism of the present invention in action.
Figure 9:
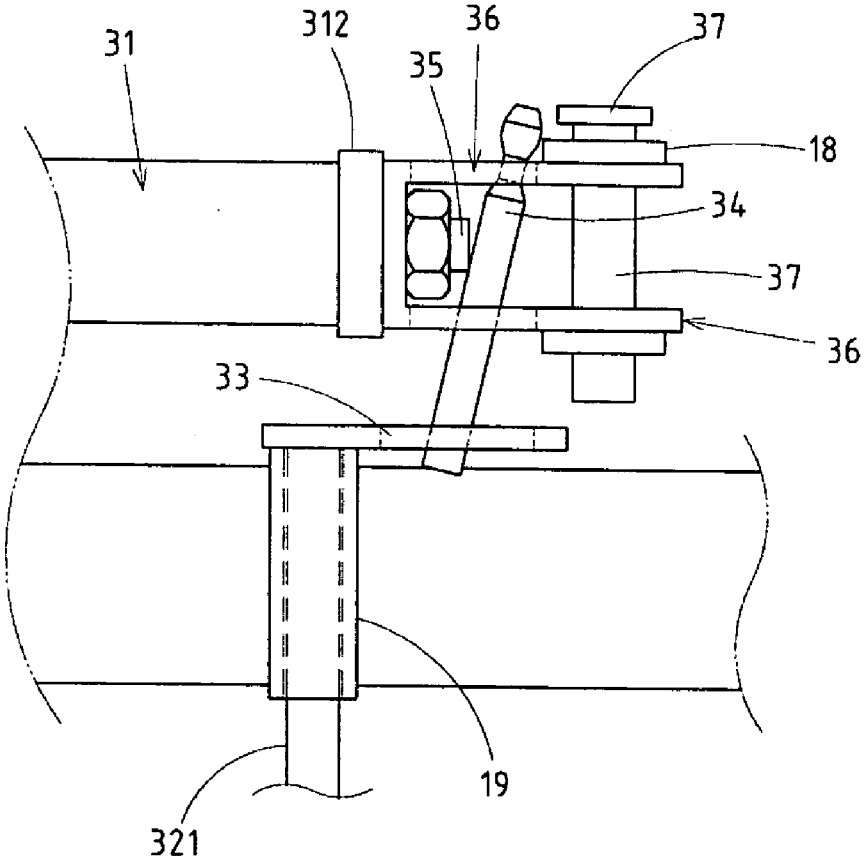
FIG. 9 shows a top plan view of the reclining mechanism of the present invention in action.
Figure 10:
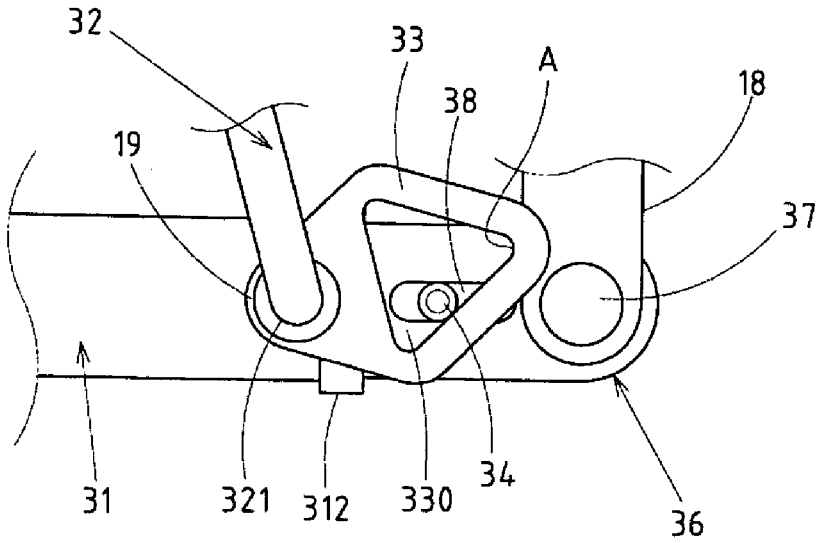
FIG. 10 shows another side schematic view of the reclining mechanism of the present invention in action.
Figure 11:
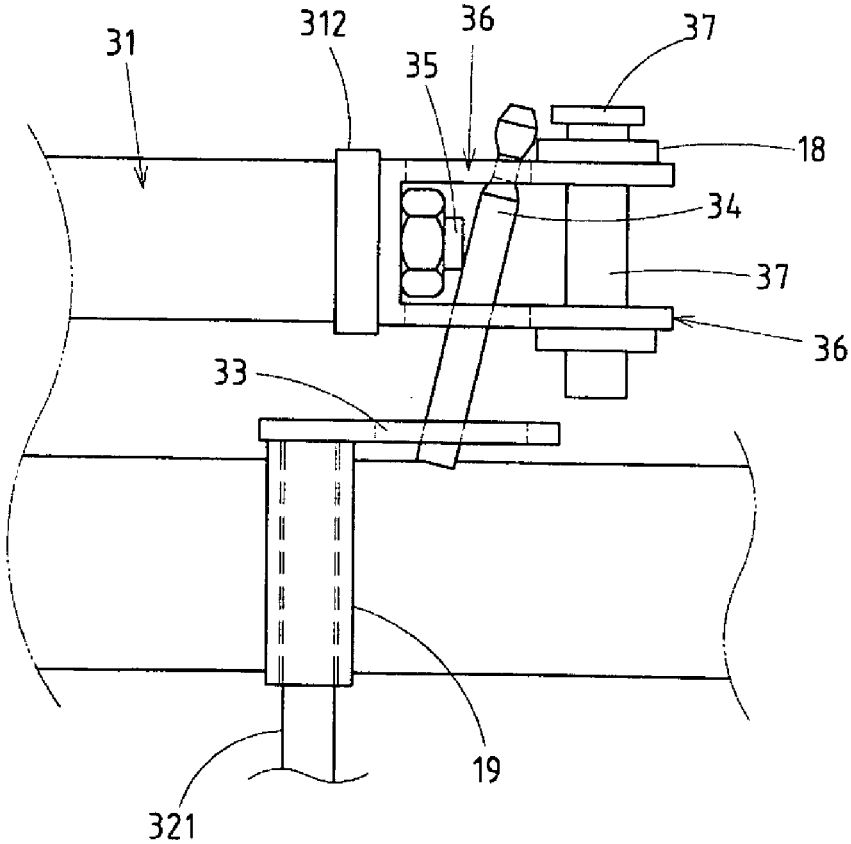
FIG. 11 shows a top plan view of the present invention as shown in FIG. 10.

The reclining mechanism is mounted under the seat frame 10 and is formed of a pressure cylinder 31, a control lever 32, a position control plate 33, and an actuation pin 34. The cylinder 31 has a first end 311, which is pivoted with the bottom end of a frame 17 of the backrest 14. The frame 17 is fastened pivotally with two pivoting seats 121 of the two rear legs 12. As a result, the backrest 14 can be adjusted for reclining on the pivoting seats 121. The cylinder 31 has a second end 312, which is provided with a pressure release knob 35 and a U-shaped support 36. The U-shaped support 36 is pivoted with a lug 18 of the seat frame 10 by a pivot 37. The U-shaped support 36 is provided with two through holes 38 for receiving the actuation pin 34. The control lever 32 has a fastening end 321, which is fastened with the position control plate 33 via a tube 19 of the seat frame 10. The position control plate 33 is provided with a triangular hole 330 in which an outer end of the actuation pin 34 is located at the "A" position of the triangular hole 330, as shown in FIG. 6. The backrest 14 is adjusted for reclining by the control lever 32. As illustrated in FIGS. 6 and 7, the pressure release knob 35 is inactivated, whereas the control lever 32 is in an upright position. Meanwhile, the outer end of the actuation pin 34 is located at the "A" position of the triangular hole 330 of the position control plate 33. As a result, the cylinder 31 remains is the state of inactivation. The backrest 14 can not be adjusted for reclining.

Figure 12:
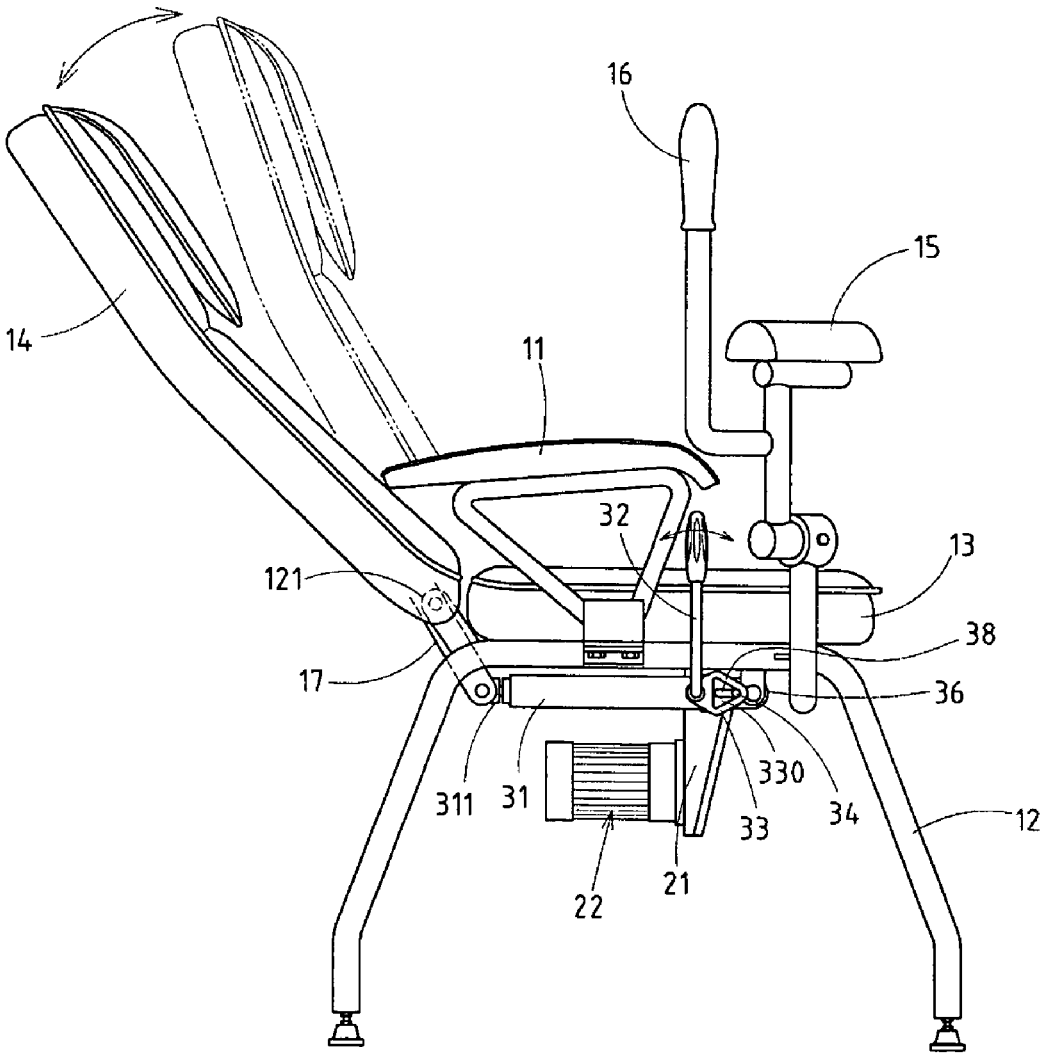
FIG. 12 shows a side schematic view of the reclining adjustment of the backrest of the present invention.

As illustrated in FIGS. 8–11, when the control lever 32 is activated, the triangular hole 330 of the position control plate 33 turns on the tube 19 of the seat frame 10, thereby resulting in displacement of the actuation pin 34. As a result, the pressure release knob 35 of the cylinder 31 is pressed against by the actuation pin 34. As soon as the cylinder 31 is activated, the backrest 14 can be adjusted for reclining, as illustrated in FIG. 12. The reclining angle of the backrest 14 can be set by a user of the chair in such a manner that the backrest 14 is pressed against by the back of the chair user to recline to desired angle, and that the control lever 32 is then deactivated to return to its original upright position so as to fix the reclining angle of the backrest 14.

As shown in FIGS. 1, 2, 5, and 12, the seat frame 10 is further provided with two leg supports pivoted therewith, and two hand grips 16 extending respectively from the leg supports 15.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A chair comprising:

a seat frame;

a seat mounted on said seat frame;

two front legs fastened at one end to said seat frame;

two rear legs fastened at one end to said seat frame; and two armrests mounted on said seat frame, wherein said seat frame has a reciprocating means for causing said seat to move up-and-down in a reciprocating manner, said reciprocating means comprising:

a fastening member fastened to an underside of said seat frame;

a drive motor mounted on said fastening member, said drive motor having an output shaft; and a transmission member fastened at a bottom end with said output shaft of said drive motor, said transmission member having a contact portion at top end thereof which comes in contact with an underside of said seat whereby said seat is pushed by said contact portion of said transmission member to engage in a series of repeated up-and-down motions at such time when said drive motor is in operation, said seat frame having a backrest pivoted therewith, said seat frame having a reclining means mounted in said underside thereof for adjustably reclining said backrest, said reclining means comprising;

a cylinder;

a control lever;

a position control plate;

an actuation pin, said cylinder being pivoted at a first end thereof with said backrest and having a pressure release knob at a second end thereof; and a U-shaped support pivoted with said seat frame and having two receiving holes receiving said actuation pin such that one end of said actuation pin is movably located in a triangular hole of said position control plate which is fastened with said control lever whereby said position control plate is actuated to turn by said control lever, thereby resulting in displacement of said actuation pin such that said pressure release knob of said cylinder is activated by said actuation pin so as to adjustably recline said backrest.

2. The chair as defined in claim 1, wherein said transmission member is eccentrically fastened at the bottom end thereof with said output shaft of said drive motor, the top end of said transmission member extends through a guide seat.

3. The chair as defined in claim 1, wherein said seat of said seat frame has a receptacle in said underside thereof, said contact portion of the top end of said transmission member is received in said receptacle of said seat.

4. The chair as defined in claim 3, wherein said receptacle has a locating means for locating said contact portion of the top end of said transmission member.

5. The chair as defined in claim 4, wherein said locating means of said receptacle is a bolt whereby said bolt has a shank, said contact portion of the top end of said transmission member is pressed against by said shank of said bolt.

6. The chair as defined in claim 1, wherein said seat frame has two leg supports pivoted therewith.

7. The chair as defined in claim 6, wherein said seat frame has two hand grips whereby said two hand grips are respectively extended from said leg supports.

* * * * *